US008242987B2

(12) United States Patent
Kasai et al.

(10) Patent No.: US 8,242,987 B2
(45) Date of Patent: Aug. 14, 2012

(54) DISPLAY DEVICE

(75) Inventors: Naruhiko Kasai, Yokohama (JP); Masato Ishii, Tokyo (JP); Mitsuhide Miyamoto, Kawasaki (JP); Tohru Kohno, Kokubunji (JP); Hajime Akimoto, Kokubunji (JP)

(73) Assignees: Hitachi Displays, Ltd., Chiba (JP); Panasonic Liquid Crystal Display Co., Ltd., Hyogo-ken (JP)

( * ) Notice: Subject to any disclaimer, the term of this patent is extended or adjusted under 35 U.S.C. 154(b) by 1018 days.

(21) Appl. No.: 12/123,498

(22) Filed: May 20, 2008

(65) Prior Publication Data

US 2008/0291193 A1 Nov. 27, 2008

(30) Foreign Application Priority Data

May 25, 2007 (JP) ..... 2007-139344

(51) Int. Cl.
*G09G 3/30* (2006.01)
*G09G 5/00* (2006.01)

(52) U.S. Cl. ..... 345/77; 345/213

(58) Field of Classification Search ..... 345/60–68, 345/76–83, 87–100, 204, 690; 348/173
See application file for complete search history.

(56) References Cited

U.S. PATENT DOCUMENTS

| | | | | |
|---|---|---|---|---|
| 8,009,129 | B2 | 8/2011 | Matsuo et al. | |
| 8,022,899 | B2 | 9/2011 | Takahara | |
| 2005/0093850 | A1* | 5/2005 | Mori et al. | 345/204 |
| 2005/0174306 | A1* | 8/2005 | Agari et al. | 345/76 |
| 2006/0007208 | A1* | 1/2006 | Aoki | 345/204 |
| 2006/0139254 | A1* | 6/2006 | Hayakawa et al. | 345/76 |
| 2008/0238833 | A1 | 10/2008 | Hioki et al. | |
| 2011/0273435 | A1 | 11/2011 | Umezaki et al. | |

FOREIGN PATENT DOCUMENTS

| | | |
|---|---|---|
| JP | 2004-287345 | 10/2004 |
| JP | 2006-235608 | 9/2006 |
| JP | 2007-86758 | 4/2007 |
| JP | 2008-242323 | 10/2008 |
| JP | 2008-250069 | 10/2008 |
| WO | WO 2005/109389 | 11/2005 |
| WO | WO 2006/000101 | 1/2006 |
| WO | WO 2006/063448 | 6/2006 |

* cited by examiner

*Primary Examiner* — Kevin M Nguyen
*Assistant Examiner* — Sepideh Ghafari
(74) *Attorney, Agent, or Firm* — Antonelli, Terry, Stout & Kraus, LLP.

(57) ABSTRACT

Detection voltages of self light emitting elements in a self-luminous display panel are detected by a detection circuit through a selection switch in a data line drive circuit via pixel detection switches and interactive signal lines. The detection operation is performed by making use of a power source supply time and a retracing period.

16 Claims, 8 Drawing Sheets

DISPLAY DEVICE

CLAIM OF PRIORITY

The present application claims priority from Japanese application serial no. 2007-139344 filed on May 25, 2007, the content of which is hereby incorporated by reference into this application.

BACKGROUND OF THE INVENTION

1. Field of the Invention

The present invention relates to a display device which mounts self light emitting elements such as EL (electroluminescence) elements, organic EL elements, or other self-luminous display elements thereon.

2. Description of the Related Art

A self light emitting element represented by an EL (electroluminescence) element, an organic EL element or the like has a property that the light-emission brightness is proportional to a quantity of electric current which flows in the self light emitting element and hence, a gray-scale display can be realized by controlling the quantity of electric current which flows in the self light emitting element. A display device can be manufactured by arranging a plurality of such self light emitting elements.

However, the self light emitting element has the characteristic that when the self light emitting element is used for a long time, the degradation of the self light emitting element progresses with time thus lowering the light-emission brightness thereof, wherein the degree of degradation depends on the duration of light emission. Accordingly, a burn-in-like pattern is generated corresponding to a light emission state (display pattern) of an individual pixel.

JP-A-2004-287345 discloses a technique which measures the light emission characteristic of an organic EL element which constitutes a self light emitting element and corrects display data based on the measured light emission characteristic. Here, the measured light emission characteristic is a quantity of electric current which flows in the self light emitting element, and a value of the measured current quantity is stored in a memory capacitance after A/D conversion. By adding a correction quantity corresponding to the stored current quantity to the display data, the irregularities of the light emission characteristic is corrected. In this manner, to ensure the stable light emission brightness among pixels of an organic EL display panel, a measurement result acquired by the current measurement is subject to the A/D conversion, and the acquired digital data is fed back to a drive signal for a light emitting element.

Although JP-A-2004-287345 discloses the detection of the current quantity at the time of display, this patent document does not take into consideration a detection time, the appearance attributed to a display state at the time of detection and the operability. Further, at the time of detection, a specific display, for example, a white display is performed, and when the detection time is prolonged, it is expected that a user is forced to continuously observe the display.

SUMMARY OF THE INVENTION

In the invention, due to the degradation characteristic of an organic EL element, a voltage when a fixed current is applied to the organic EL element is elevated at the time of degradation of the organic EL element, and then this elevation of voltage is detected. Here, the fixed current is applied via a signal line and hence, it is necessary to separate the display and the detection with the result that the display cannot be performed at the time of detection.

Further, there has been also proposed a method which detects current quantity by making use of a retracing period. Since the retracing period is limited, the detection merely slightly influences the display. However, a considerable time elapses until the detection of the whole screen is completed, that is, until the burn-in correction is finished.

For example, since the burn-in correction is not performed at the time of supplying a power source, a user can recognize the burn-in until the correction is finished after the power source is supplied. On the other hand, when the display is stopped and the detection is performed in a concentrated manner only at the time of supplying the power source, a time until the burn-in correction is finished can be shortened. However, the display is not performed during the time and hence, the display cannot be performed immediately after the supply of the power source. It is considered that a stress is imposed on the user depending on the application such as a mobile phone or a digital camera.

The present invention performs the detection of an electric current at the time of supplying a power source not on the whole screen but on a necessity-minimum region, and performs the detection of a remaining portion of the screen by making use of a retracing period thus performing the detection which does not influence a display. Here, the necessity-minimum region is a region which makes human eyes difficult to recognize the burn-in by correcting only the burn-in of such a portion.

As the necessity-minimum region, for example, a region where a fixed pattern such as icons is always displayed, only even-numbered (or odd-numbered) dots on a screen, even-numbered (or odd-numbered) lines on the screen, every arbitrary number of dots, every arbitrary number of lines and the like are considered.

Due to the above-mentioned constitution, according to the present invention, by minimizing the detection region at the time of supplying the power source, the detection time of the current quantity at the time of starting the operation of the display device can be shortened most. Further, due to the detection of current quantity during the retracing period, the present invention can cope with the change of characteristic of display elements attributed to a temperature change or the like. Accordingly, the present invention can realize a display with no burn-in in a short time at the time of starting the operation of the display device and, at the same time, can realize the display with the least characteristic fluctuation attributed to burn-in or temperature even during a long-time display.

DESCRIPTION OF THE PREFERRED EMBODIMENT

Embodiments of the present invention are explained in conjunction with drawings hereinafter.

[Embodiment 1]

Figure 1:
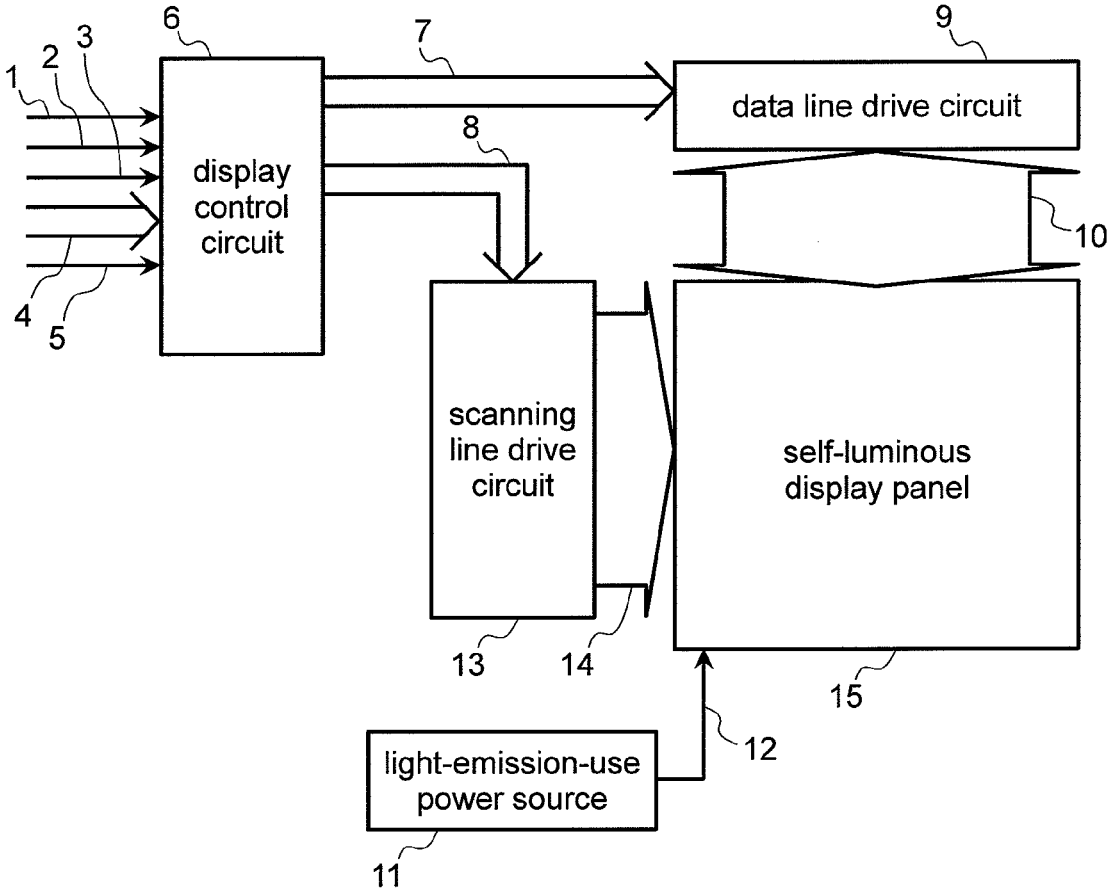
FIG. 1 is an overall constitutional view of a display device according to the present invention.

FIG. 1 is an overall constitutional view of a display device according to the present invention. Although this embodiment has substantially the same constitution as a conventional self-luminous display device, the display device of this embodiment differs from the conventional display device with respect to a point that a data line drive circuit 9 includes a burn-in detection function therein. Due to the provision of the burn-in detection function, an interactive signal 10 is used as a signal transmitted between the data line drive circuit 9 and self-luminous display panels 15. That is, the signal becomes a data line drive signal at the time of display in the same manner as the conventional display device, and becomes a detection voltage from the self light emitting element in the reverse direction at the time of detection.

In FIG. 1, numeral 1 indicates a vertical synchronizing signal, numeral 2 indicates a horizontal synchronizing signal, numeral 3 indicates a data enable signal, numeral 4 indicates display data, and numeral 5 indicates a synchronizing clock. The vertical synchronizing signal 1 is a signal of 1 screen period (1 frame period) for displaying the display data 4, the horizontal synchronizing signal 2 is a signal of 1 horizontal period, the data enable signal 3 is a signal indicative of a period during which the display data 4 is valid (display valid period), and all signals are inputted in synchronism with the synchronizing clock 5.

Further, in FIG. 1, numeral 6 indicates a display control circuit, numeral 7 indicates a data line control signal, and numeral 8 indicates a scanning line control signal. The display control circuit 6 generates the data line control signal 7 and the scanning line control signal 8 based on the vertical synchronizing signal 1, the horizontal synchronizing signal 2, the data enable signal 3, the display data 4 and the synchronizing clock 5.

Further, numeral 9 indicates the data line drive circuit, and numeral 10 indicates the interactive signal 10. The data line drive circuit 9 generates a signal voltage to be written in pixels constituted of the self light emitting elements in response to the data line control signal 7 and outputs the data line drive signal to the self-luminous display panel 15 as the interactive signal 10.

Numeral 11 indicates a light-emission-use power source, and numeral 12 indicates a light-emission-use power source voltage. The light-emission-use power source 11 generates a power source voltage for supplying electric current which allows the self light emitting element to emit light and outputs the light-emission-use power source voltage 12 to the self-luminous display panel 15.

Numeral 13 indicates a scanning line drive circuit, numeral 14 indicates a scanning line drive signal, and numeral 15 indicates a self-luminous display panel. On the self-luminous display panel 15, self light emitting elements formed of a plurality of light emitting diodes, organic ELs or the like are arranged in a matrix array.

In the display operation of the self-luminous display panel 15, to the pixels selected in response to the scanning line drive signal 14 outputted from the scanning line drive circuit 13, a signal voltage corresponding to a data line drive signal outputted as the interactive signal 10 from the data line drive circuit 9 is written thus allowing the self light emitting elements constituting the pixels to emit light.

Further, in the detection operation of the self-luminous display panel 15, the detection voltages of the self light emitting elements which constitute the pixels are outputted to the data line drive circuit 9 as the interactive signal 10 from the self-luminous display panel 15. Here, the light-emission-use power source voltage 12 is supplied to the self-luminous display panel 15 as a voltage for driving the self light emitting elements.

In the self-luminous display panel 15, the brightness of light emitted from the self light emitting element is adjusted based on a quantity of electric current which flows in the self light emitting element and a light emission time of the self light emitting element. The larger the quantity of electric current which flows in the self light emitting element, the higher the brightness of the self light emitting element becomes. The longer the light-emission time of the self light emitting element, the higher the brightness of the self light emitting element becomes.

Figure 2:
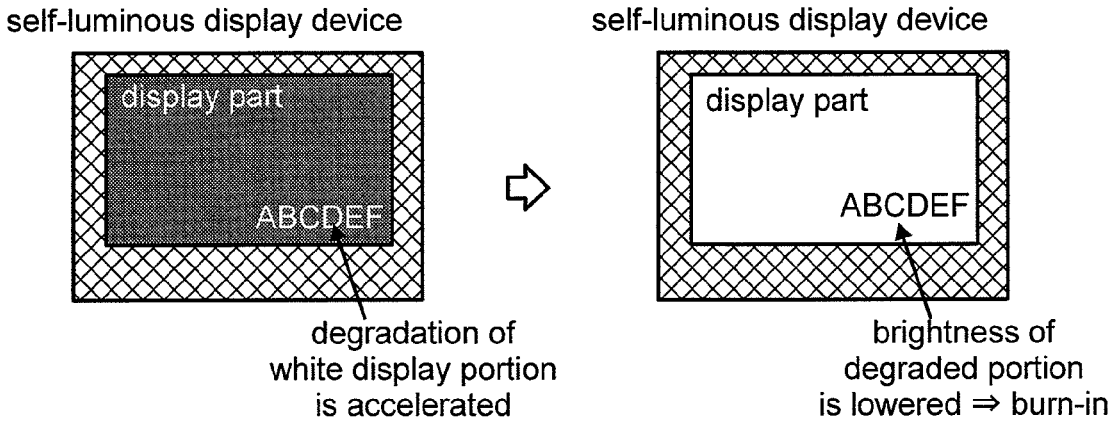
FIG. 2 is a view showing a burn-in phenomenon of a self-luminous display device.

FIG. 2 is a view showing a burn-in phenomenon of the self-luminous display device. When a white display of ABCDEF is performed on the same portion of a display part shown at a left side of FIG. 2 for a long time, for example, only the self light emitting elements in the white display are degraded so that the brightness of the self light emitting elements is lowered. As a result, as shown in the right side of FIG. 2, the brightness of the degraded self light emitting elements is lowered thus giving rise to a burn-in phenomenon.

Figure 3:
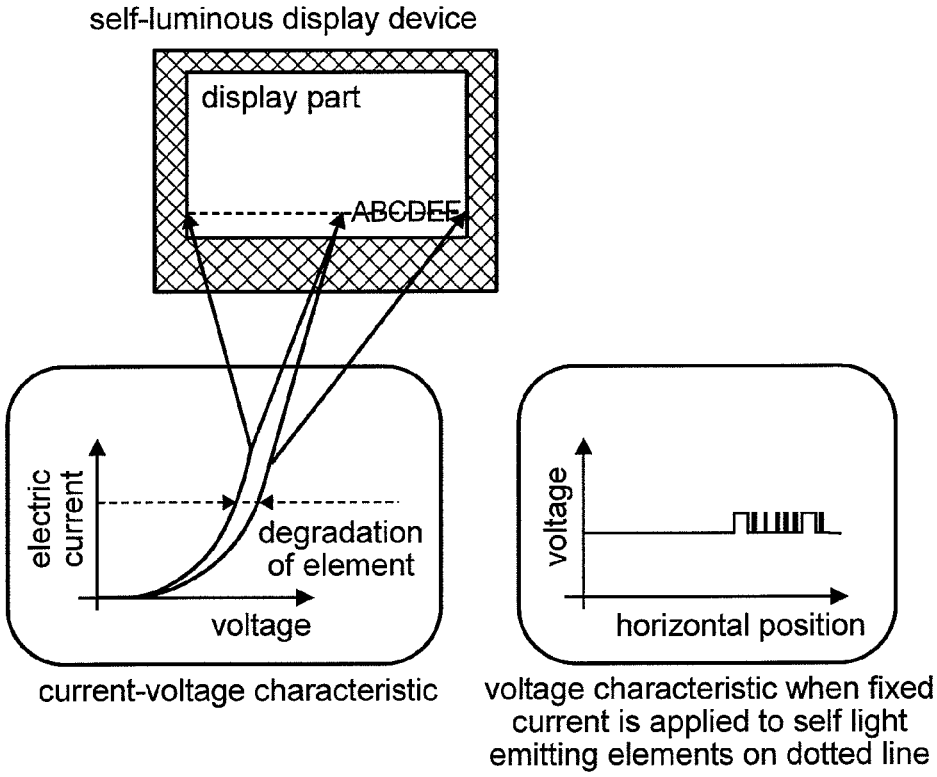
FIG. 3 is a view showing degradation characteristic of a self light emitting element.

FIG. 3 is a view showing the degradation characteristic of the self light emitting elements. Attributed to the degradation of the self light emitting elements with time, as shown at the lower left side of the FIG. 3, the current-voltage characteristic is changed in the direction that a gradient is decreased and hence, a voltage is elevated with respect to a fixed current. In the present invention, this voltage change is detected. At the lower right side of FIG. 3, a voltage of a horizontal dotted line portion shown at the upper side of FIG. 3 is shown. In a display portion ABCDEF, the self light emitting elements are degraded and hence, the voltage of this portion is elevated.

Figure 4:
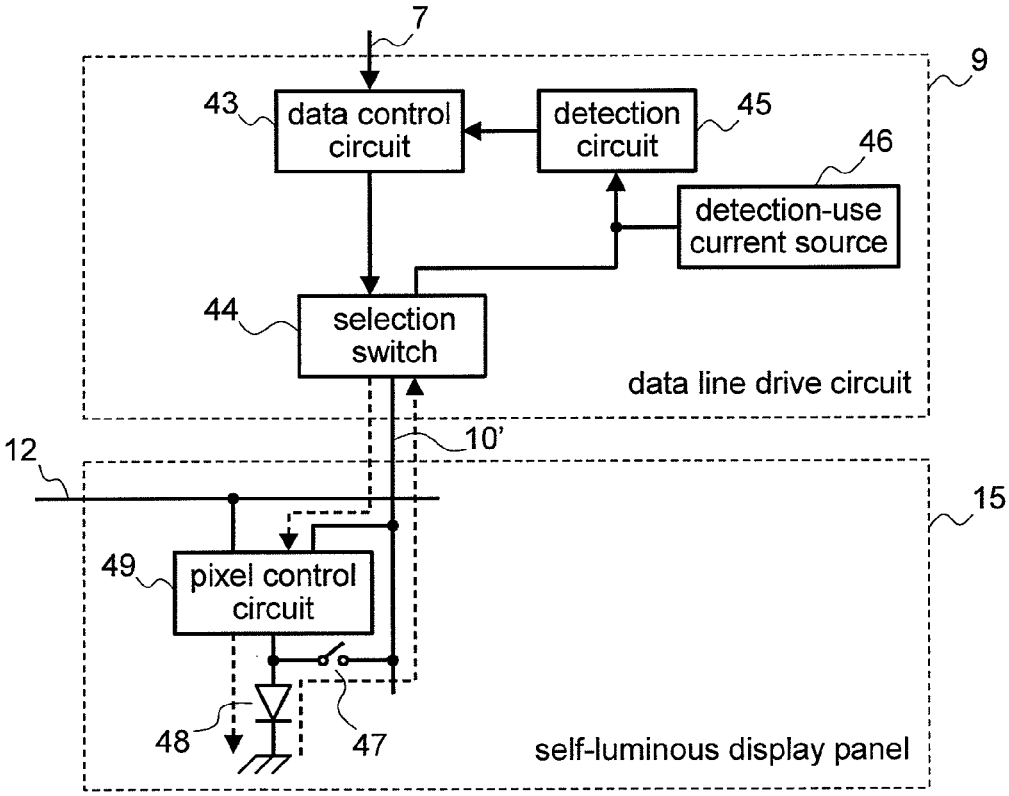
FIG. 4 is a constitutional view of a data line drive circuit and a self-luminous display panel shown in FIG. 1.

FIG. 4 is a constitutional view of the data line drive circuit 9 and the self-luminous display panel 15 shown in FIG. 1. The data line drive circuit 9 includes a data control circuit 43, a selection switch 44, a detection circuit 45 and a detection-use current source 46. The self-luminous display panel 15 includes a pixel detection switch 47, self light emitting elements 48 and pixel control circuits 49.

In FIG. 4, the data line control signal 7 is inputted to the data control circuit 43 of the data line drive circuit 9. The data control circuit 43 performs a timing control or a data control of the display data using the data line control signal 7. A flow of a signal in the inside of the data line drive circuit 9 is substantially constituted of three kinds of paths, that is, a display path, a detection path and a correction path.

The display path is the flow of the display data through the data control circuit 43, the selection switch 44 and the interactive signal line 10' in the inside of the data line drive circuit 9 and enters the self-luminous display panel 15 to drive the self light emitting element 48 using the light-emission-use power source voltage 12 through the pixel control circuit 49 in the inside of the self-luminous display panel 15.

The detection path is the flow of the signal from the self light emitting element 48 in the self-luminous display panel 15 to the detection circuit 45 through the pixel detection switch 47 and the interactive signal line 10' and through the selection switch 44 in the data line drive circuit 9.

The correction path is the flow of the signal from the detection circuit 45 to the data control circuit 43 in the data line drive circuit 9 and corrects the display data.

The selection switch 44 is provided for changing over the direction of data between the time of display and the time of detection. Further, at the time of display, the light-emission-use power source voltage 12 is used as a power source of the self-luminous display panel 15. At the time of detection, the detection-use current source 46 is used as a power source of the self-luminous display panel 15. Here, in place of detecting the voltage using the detection-use current source 46, the detection of the current may be performed using a detection-use voltage source.

Figure 5:
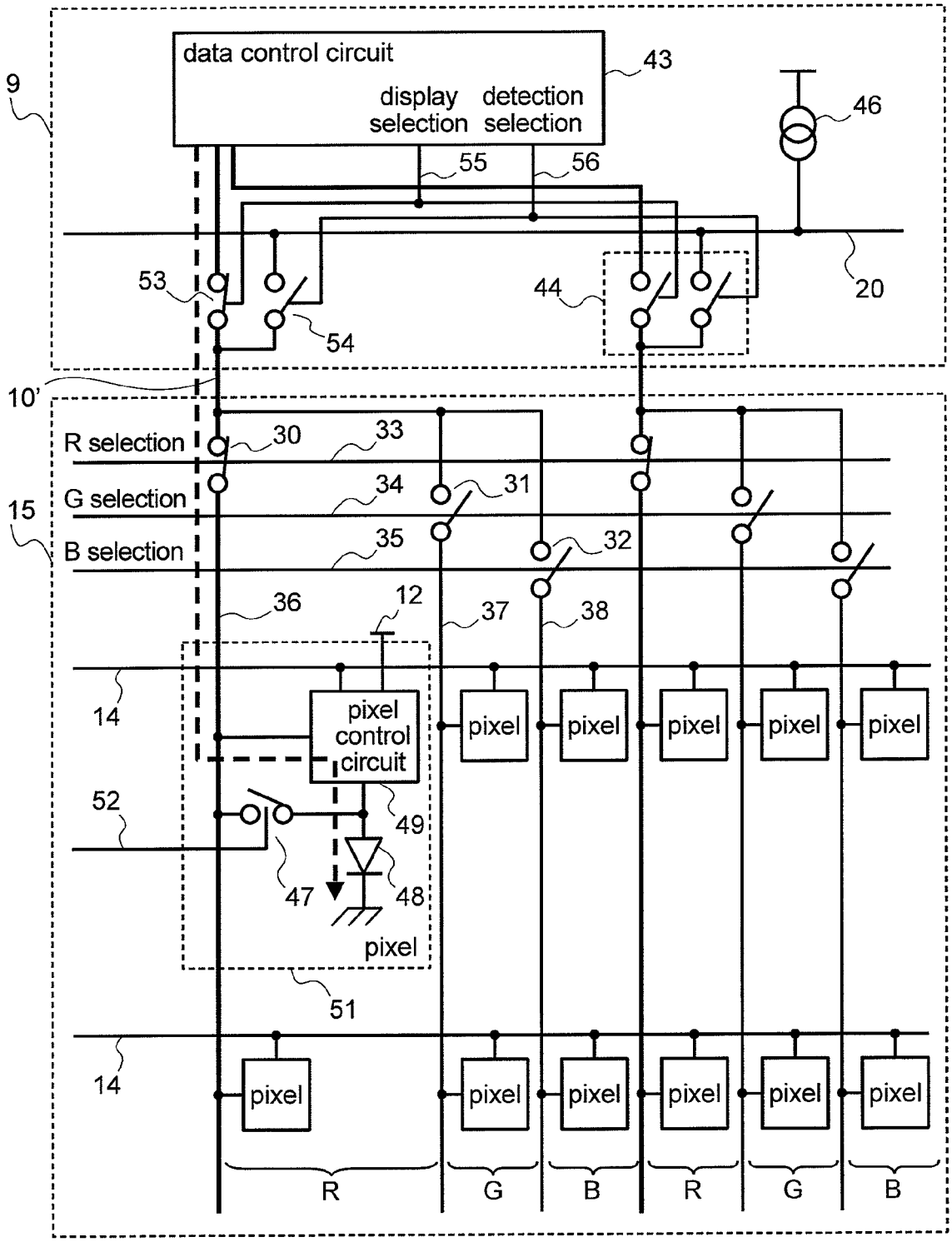
FIG. 5 is a detailed constitutional view of the data line drive circuit and the self-luminous display panel shown in FIG. 4.

FIG. 5 is a detailed constitutional view of the data line drive circuit 9 and the self-luminous display panel 15 shown in FIG. 4, and shows a state at the time of display. The pixel 51 is constituted of the self light emitting element 48, the pixel control circuit 49 and the pixel detection switch 47. The pixel detection switch 47 is controlled in response to a pixel selection signal 52 from the data control circuit 43. The selection switch 44 is constituted of a display selection switch 53 and a detection selection switch 54. The display selection switch 53 is controlled in response to a display selection signal 55 from the data control circuit 43, while the detection selection switch 54 is controlled in response to a detection selection signal 56 from the data control circuit 43.

Further, the display device of this embodiment is configured such that the respective pixels of R, G, B are controlled by time-division processing. The interactive signal line 10' and the respective pixels of R, G, B are connected with each other by an R selection switch 30, a G selection switch 31 and a B selection switch 32. The R selection switch 30 is controlled in response to an R selection signal 33. The G selection switch 31 is controlled in response to a G selection signal 34. The B selection switch 32 is controlled in response to a B selection signal 35. The respective pixels of R and the R selection switch 30 are connected with each other by an R signal line 36. The respective pixels of G and the G selection switch 31 are connected with each other by a G signal line 37. The respective pixels of B and the B selection switch 32 are connected with each other by a B signal line 38. The pixel selection signal 52, the R selection signal 33, the G selection signal 34 and the B selection signal 35 may be controlled by the data control circuit 43 or by other independent circuit.

Next, the manner of operation of the circuit shown in FIG. 5 is explained. At the time of display, in response to the display selection signal 55 and the detection selection signal 56 from the data control circuit 43, the display selection switch 53 is turned on and the detection selection switch 54 is turned off. In such a state, the display data is supplied to the interactive signal line 10'.

Then, at the time of displaying R, in a state that the R selection switch 30 controlled by time-division processing is ON, the G selection switch 31 controlled by time-division processing is OFF, the B selection switch 32 controlled by time-division processing is OFF, and the pixel detection switch 47 is OFF, in response to the display data from the data control circuit 43, the pixel control circuit 49 controls the light-emission-use power source voltage 12 so as to apply a voltage to the self light emitting element 48 thus allowing the self light emitting element 48 to emit light.

In the same manner, at the time of displaying G, in a state that the G selection switch 31 controlled by time-division processing is ON, the R selection switch 30 controlled by time-division processing is OFF, the B selection switch 32 controlled by time-division processing is OFF, and the pixel detection switch 47 is OFF, in response to the display data from the data control circuit 43, the pixel control circuit 49 controls the light-emission-use power source voltage 12 so as to apply a voltage to the self light emitting element 48 thus allowing the self light emitting element 48 to emit light.

Further, at the time of displaying B, in a state that the B selection switch 32 controlled by time-division processing is ON, the R selection switch 30 controlled by time-division processing is OFF, the G selection switch 31 controlled by time-division processing is OFF, and the pixel detection switch 47 is OFF, in response to the display data from the data control circuit 43, the pixel control circuit 49 controls the light-emission-use power source voltage 12 so as to apply a voltage to the self light emitting element 48 thus allowing the self light emitting element 48 to emit light. In this manner, the respective R, G, B selection switches are controlled to sequentially allow the self light emitting element to emit light.

Figure 6:
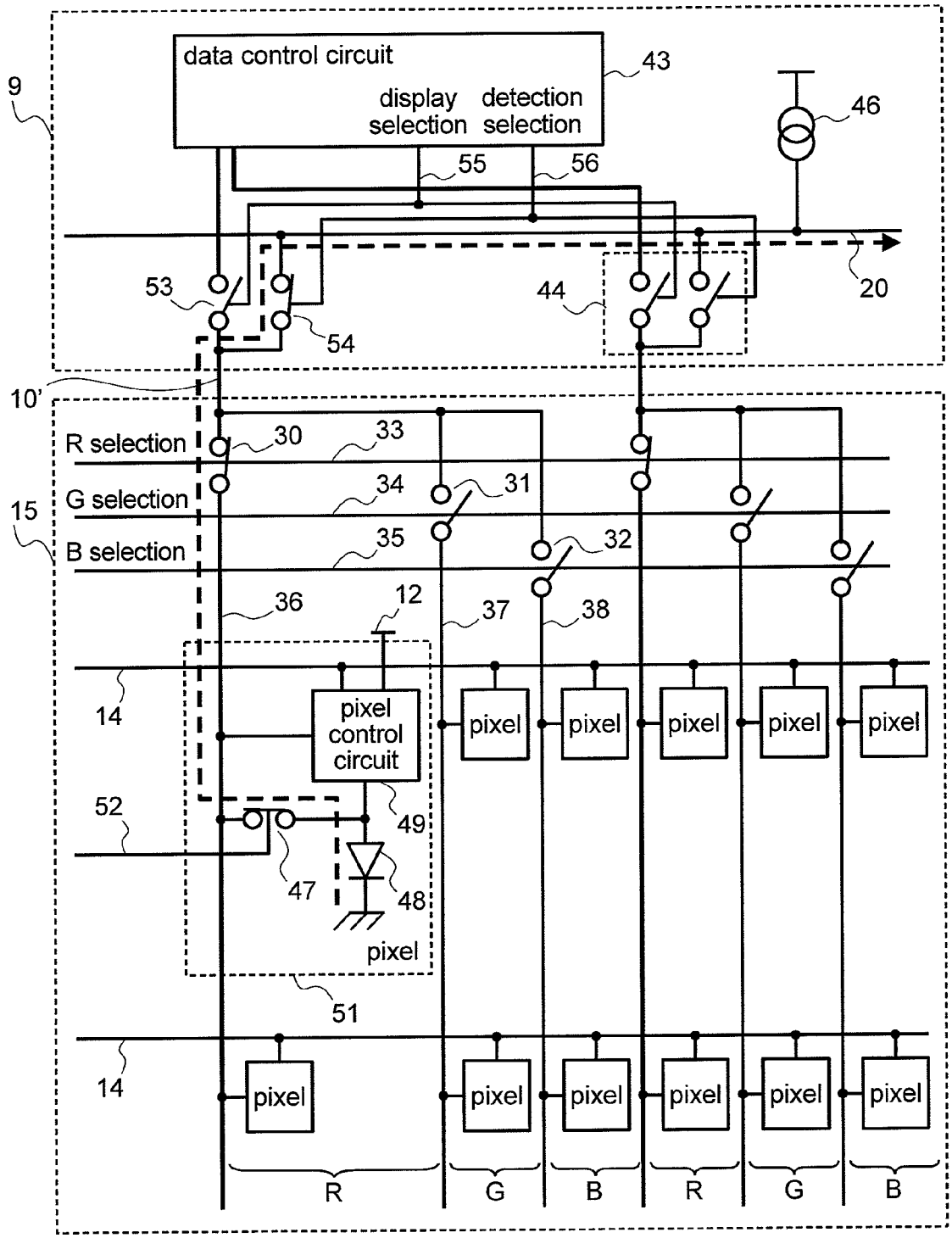
FIG. 6 is a view showing the manner of operation of the display device having the same constitution as the constitution shown in FIG. 5 at the time of detection.

FIG. 6 shows the manner of operation of the display device having the same constitution as the constitution shown in FIG. 5 at the time of detection. At the time of detection, in response to the display selection signal 55 and the detection selection signal 56 from the data control circuit 43, the display selection switch 53 is turned off and the detection selection switch 54 is turned on. In this state, the interactive signal line 10' is connected to the detection line 20. At the time of detection, it is necessary to read the state (degradation characteristic or light emission characteristic) of the self light emitting element 48 and hence, the pixel control circuit 49 cuts off the light-emission-use power source voltage 12. With respect to the pixel to be detected, by turning on the pixel detection switch 47, the self light emitting element 48 is connected to the interactive signal line 10'.

Here, to detect the pixel of R, the R selection switch 30 is turned on and the pixel detection switch 47 of the pixel of R is turned on. The detection-use current source 46 is connected to the detection line 20 and, due to the characteristic of the self light emitting element 48, a fixed voltage is generated in the interactive signal line 10' and hence, the state of the self light emitting element 48 is expressed through the detection line 20.

In the same manner, to detect the pixel of G, the G selection switch 31 is turned on and the pixel detection switch 47 of the pixel of G is turned on and hence, the state of the self light emitting element 48 is expressed through the detection line 20.

Further, to detect the pixel of B, the B selection switch 32 is turned on and the pixel detection switch 47 of the pixel of B is turned on and hence, the state of the self light emitting element 48 is expressed through the detection line 20.

Figure 7:
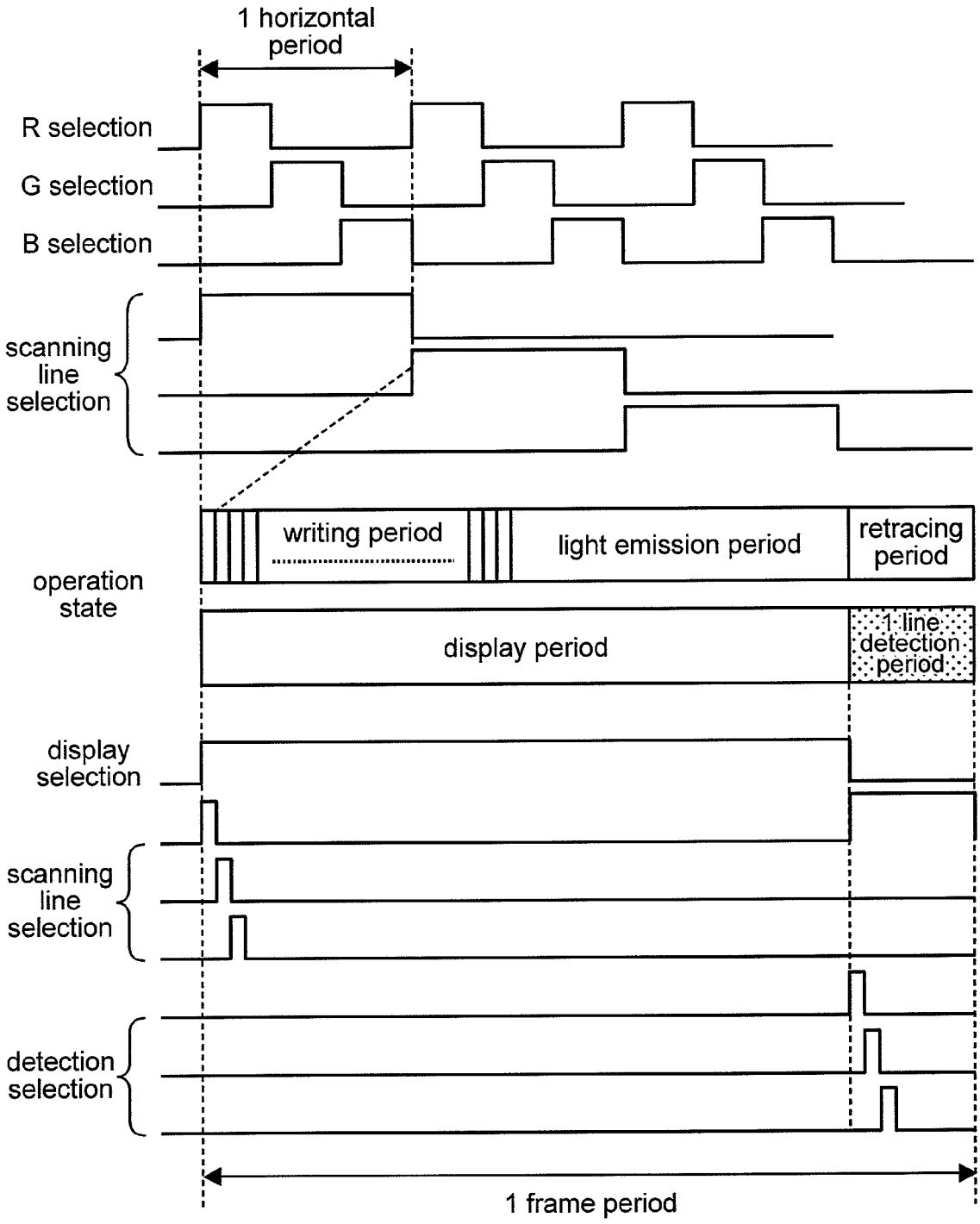
FIG. 7 is a timing waveform diagram at the time of writing operation of the display data.

FIG. 7 is a timing waveform diagram at the time of writing operation of the display data. In FIG. 7, the scanning line selection is sequentially performed for every 1 horizontal period. For example, the scanning line selection is performed on the display panel from above to below. In each period, the R, G, B selections are sequentially performed. After the scanning line selection reaches the lowermost scanning line, the light emission period starts. After the light emission period is finished, a retracing period follows, and this retracing period is used as the detection period. The display selection is performed during the writing period and the light emission period, and these periods are used as the display period.

In this embodiment, the explanation is made assuming that the characteristic of pixel for 1 line is detected during the detection period. Since the detection is performed for 1 line, the scanning line selection is sequentially performed for every detection period. Accordingly, the scanning line selection is sequentially performed during 1 frame period at the time of writing signal of the display data, while at the time of detection operation, the scanning line selection is sequentially performed for every N (N being the number of detection lines) frames. The detection selection is performed by detecting the characteristic by applying a fixed current for every interactive signal line and hence, the detection selection is sequentially performed for every retracing period, for example, from the left to the right.

Figure 8:
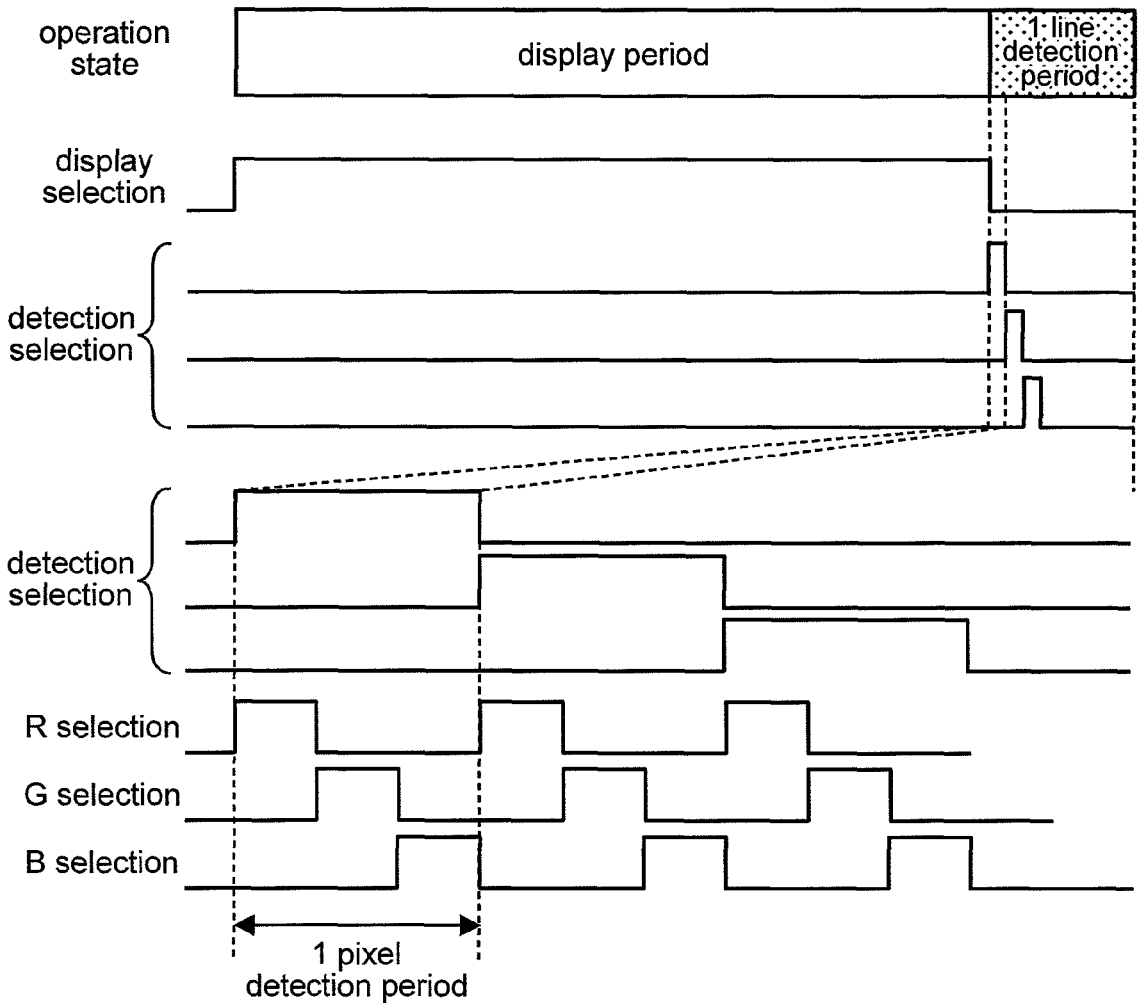
FIG. 8 is a timing waveform diagram showing the time direction of 1 line detection period in an enlarged manner.

FIG. 8 is a timing waveform diagram showing the time direction of 1 line detection period in an enlarged manner. During the period of the detection selection in which one interactive signal line is selected, the R, G, B selections are sequentially performed so as to perform the detection for one pixel.

Figure 9:
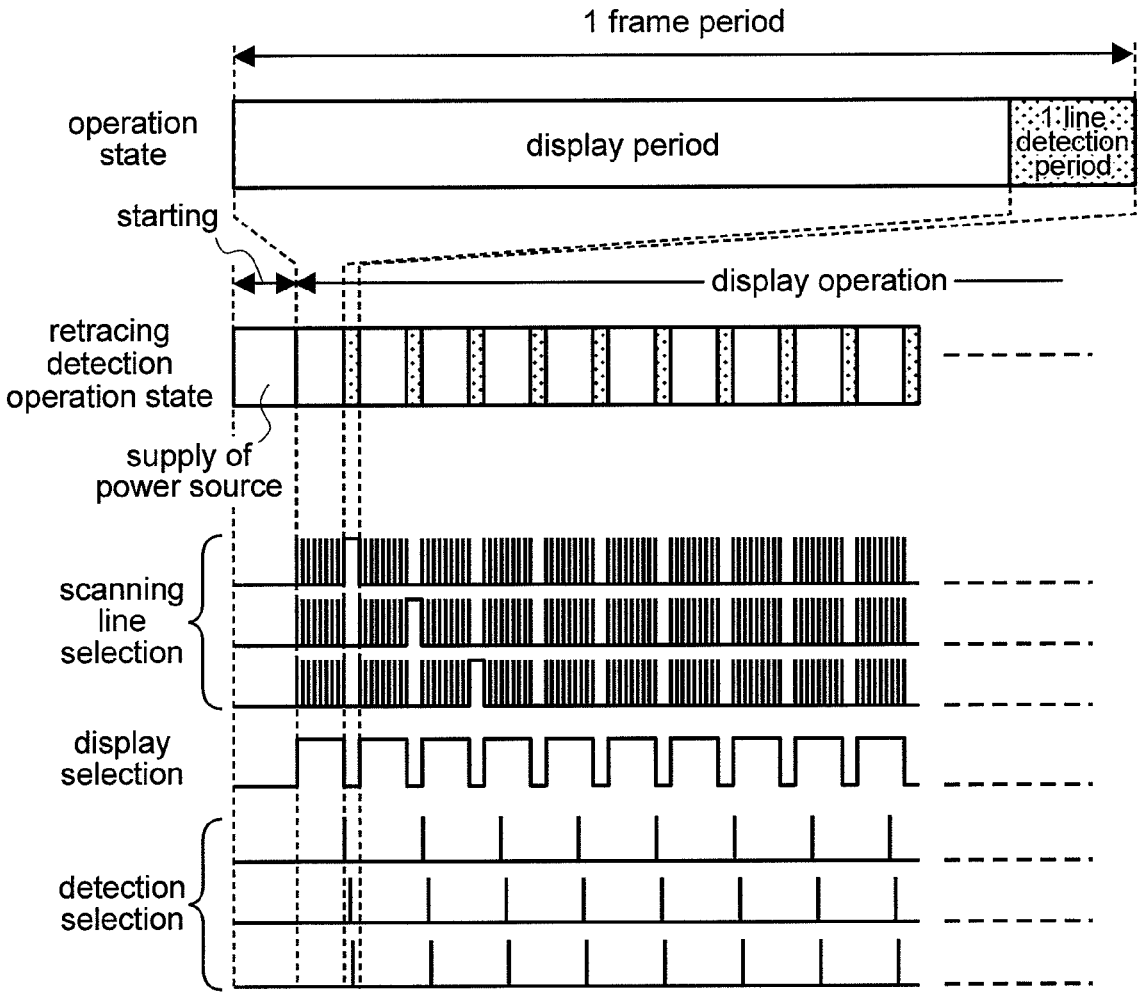
FIG. 9 is a timing waveform diagram when the detection is performed for only retracing period.

FIG. 9 is a timing waveform diagram when the detection is performed only during the retracing period, and the timing waveform diagram is shown over several frames (several hundreds ms). Immediately after the power source is supplied, the display operation is performed, and the detection operation is performed only during the retracing period. The respective selection operations are as explained in conjunction with FIG. 7 and FIG. 8. An advantage of this operation lies in that since the display is performed immediately after the power source is supplied, there is almost no non-display period at the time of starting the operation of the display device. However, for detecting the presence or non-presence of the burn-in over the whole screen, when 480 lines are driven at 60 Hz, 8 (=480×1/60) seconds become necessary. Accordingly, when the burn-in is generated although the display is performed, it takes 8 seconds to eliminate the burn-in. This time is determined depending on a load applied to the interactive signal line. When the detection for 1 line is impossible during the retracing period, a further longer time becomes necessary.

Figure 10:
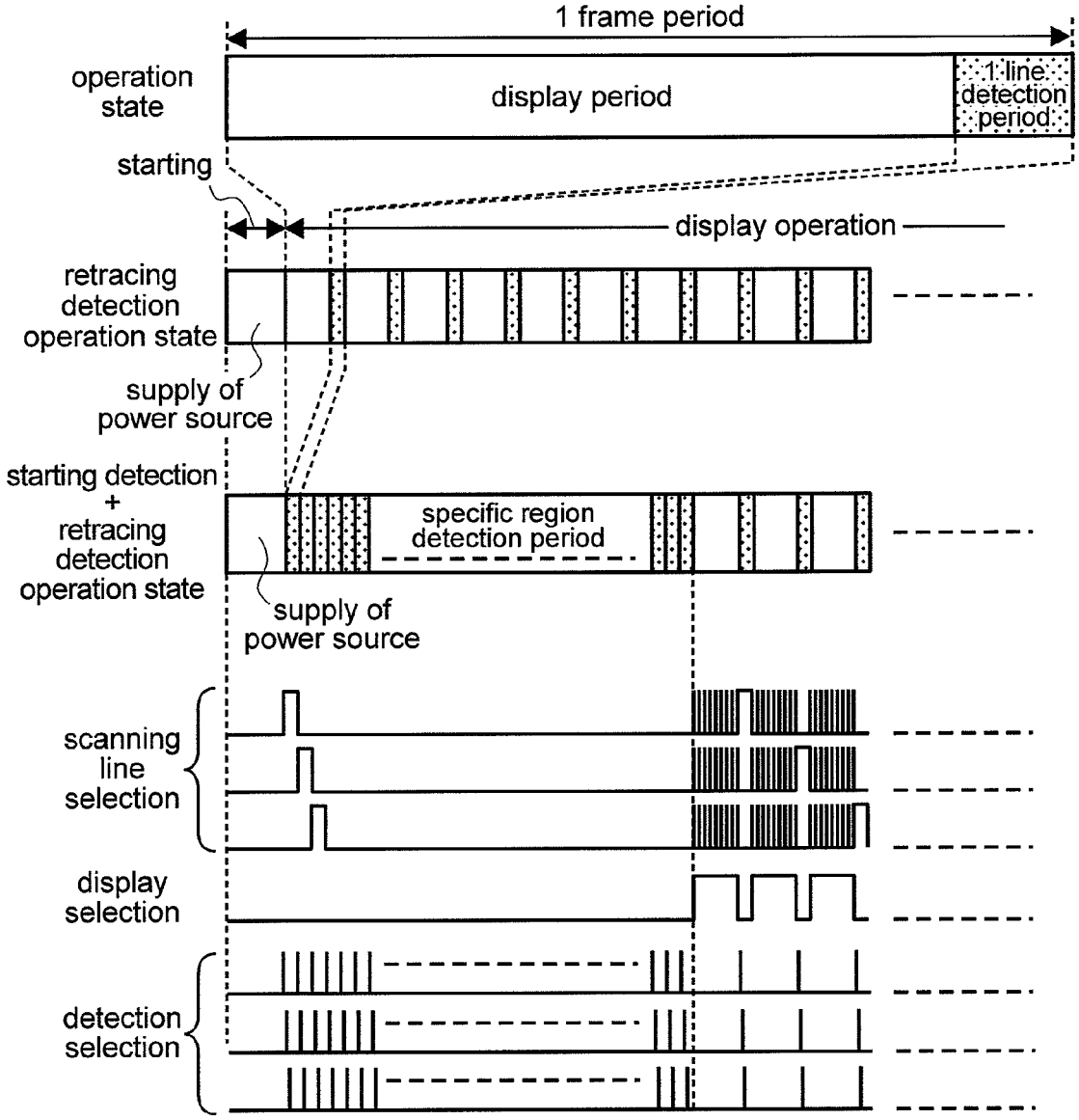
FIG. 10 is a timing waveform diagram when the detection at the time of starting and the detection during the retracing period are performed.

FIG. 10 is a timing waveform diagram when the detection is performed at the time of starting and when the detection is performed during the retracing period. First of all, the explanation made with respect to a case in which the detection is performed in a concentrated manner only during the starting time. Since the detection operation is performed immediately after the power source is supplied, the display operation is performed after the detection operation is finished. An advantage of this operation lies in that since the display is performed after the detection operation, when the display is performed, the burn-in has been already eliminated. However, a non-display state at the time of detection requires 0.8 seconds for detecting the presence or non-presence of burn-in over the whole screen when the number of lines on the screen is 480 lines. That is, when 480 lines are driven during the frame period of 60 Hz (≅16.7 ms), assuming the retracing period as 1/10 of the frame period (≅1.7 ms), the non-display state requires 0.8 seconds (1.7 ms×480-0.8 seconds). In this manner, the display device assumes the non-display state during this time. This time is determined depending on a load applied to the interactive signal line and hence, when the detection for 1 line is impossible during the retracing period, the non-display state continues for a further longer period.

Next, the explanation is made with respect to a case in which the detection is performed at the time of starting and the detection is performed during the retracing period. After the power source is supplied, the detection is not performed with respect to all lines, that is, 480 lines, for example. Instead, a specified region of the screen is detected and, thereafter, the detection is performed over the specified region during the retracing period. Here, the display device may be controlled such that states of the self light emitting elements are detected without displaying the display data in the specified region and, at the same time, the self light emitting elements are allowed to display the display data in a region other than the specified region.

Figure 11:
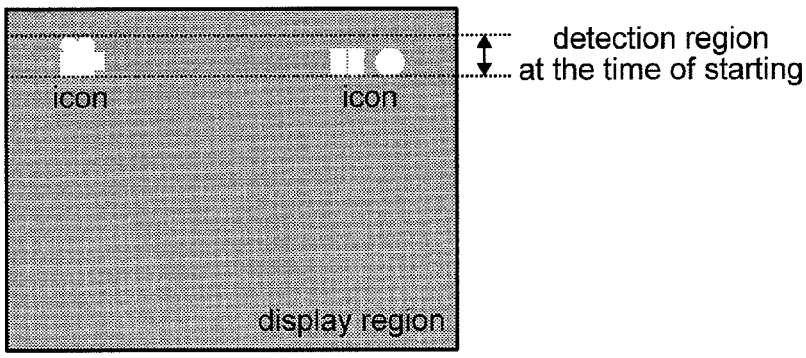
FIG. 11 is a view showing a case in which the burn-in detection is limited to a specified region in the inside of a display region.

FIG. 11 is a view showing a case in which the burn-in detection is limited to a specified region in the display region. When the burn-in detection is performed at the time of starting, it is effective to limit the detection region to a portion of the screen where the burn-in is liable to occur. For example, when icons or a fixed pattern are displayed in a specified region as in the case of a digital camera or a mobile phone, the presence or the non-presence of the burn-in is detected with respect to only the region at the time of starting and the burn-in is corrected. Due to such an operation, a possibility that the user recognizes the burn-in can be lowered and the detection time can be also shortened. The detection of the presence or the non-presence of the burn-in is, although the detection takes a longer time, also performed with respect to remaining regions of the screen during the retracing period at the time of normal display operation after the starting. Eventually, the burn-in can be detected and corrected over the whole screen and hence, no problem arises. The limited region may be an icon display region, a region corresponding to every 1 line, a region corresponding to every 1 dot, a region corresponding to every several lines or a region corresponding to every several dots.

What is claimed is:

1. A display device comprising:

a display panel;

self light emitting elements arranged on the display panel in a matrix array;

a scanning line drive circuit and a data line drive circuit for driving the self light emitting elements; and signal lines for connecting the data line drive circuit and the display panel, wherein the data line drive circuit is configured to detect states of the self light emitting elements at a time of powering up of the display device via the signal lines and to detect the states of the self light emitting elements during a retracing period at a time of a display operation of the display panel.

2. A display device according to claim 1, wherein the data line drive circuit includes a selection switch and performs a display operation and a detection operation by changing over the selection switch.

3. A display device according to claim 2, wherein the selection switch includes a display selection switch and a detection selection switch.

4. A display device according to claim 3, wherein the detection selection switch is connected to a detection line to which the detection-use current source is connected.

5. A display device according to claim 1, wherein the self light emitting element includes a pixel detection switch and a state of each self light emitting element is detected by changing over the pixel detection switch.

6. A display device comprising:

a display panel;

self light emitting elements arranged on a display panel in a matrix array;

a scanning line drive circuit and a data line drive circuit for driving the self light emitting elements, signal lines for connecting the data line drive circuit and the display panel, a detection circuit for detecting degradation characteristics or light emitting characteristics of the self light emitting elements, and a data control circuit which corrects the light emission of the self light emitting elements corresponding to the degradation characteristics or the light emitting characteristics of the self light emitting elements, wherein the detection circuit detects the degradation characteristics or the light emitting characteristics of some self light emitting elements formed on the display panel during a predetermined period from powering up of the display device, and detects the degradation characteristics or the light emitting characteristics of the self light emitting elements other than some self light emitting elements formed on the display panel, the degradation characteristics or the light emitting characteristics of the self light emitting elements including some self light emitting elements and other self light emitting elements formed on the display panel, or the degradation characteristics or the light emitting characteristics of all self light emitting elements formed on the display panel during a retracing period of a display operation of the display panel.

7. A display device according to claim 6, wherein the detection circuit detects the degradation characteristic or the light emitting characteristic of the self light emitting element by detecting an electric current which flows in the self light emitting element when a fixed voltage is applied to the self light emitting element or by detecting a voltage applied to the self light emitting element when a fixed current is allowed to flow in the self light emitting element.

8. A display device according to claim 6, wherein, the detection circuit detects the degradation characteristic or the light emitting characteristic of the self light emitting element without displaying display data on some self light emitting elements formed on the display panel within a predetermined period from the powering up of the display device, and displays display data on other self light emitting elements formed on the display panel.

9. A display device according to claim 6, wherein the retracing period during which the detection circuit detects the degradation characteristic or the light emitting characteristic of the self light emitting element is the retracing period after a predetermined period elapses from the powering up of the display device.

10. A display device according to claim 6, wherein some self light emitting elements formed on the display panel which the detection circuit detects during a predetermined period from the powering up of the display device are the self light emitting elements in a predetermined region set for displaying display data of a predetermined pattern, the self light emitting elements in an odd-numbered column on the display panel, the self light emitting elements in an even-numbered column on the display panel, the self light emitting elements in an odd-numbered row on the display panel, or the self light emitting elements in an even-numbered row on the display panel, or the self light emitting elements in a predetermined number of columns skipped by a predetermined number of columns on the display panel, or the self light emitting elements in a predetermined number of rows skipped by predetermined number of rows on the display panel.

11. A display device according to claim 1, wherein the states of the self light emitting elements arranged on the display panel which are detected are the self light emitting elements which are arranged in a display area of the display panel.

12. A display device according to claim 1, wherein the retracing period at the time of the display operation of the display panel is part of one frame period which occurs after a writing period of the one frame period and before a writing period of a subsequent frame period.

13. A display device according to claim 6, wherein the states of the self light emitting elements arranged on the display panel which are detected are to self light emitting elements which are arranged in a display area of the display panel.

14. A display device according to claim 6, wherein the retracing period at the time of the display operation of the display panel is part of one frame period which occurs after a writing period of the one frame period and before a writing period of a subsequent frame period.

15. A display device according to claim 1, wherein the data line drive circuit detects states of the self-light emitting elements in accordance with information indicative of the states of the self-light emitting elements supplied from the self-light emitting elements to the data line drive circuit via the signal lines.

16. A display device according to claim 6, wherein the detection circuit detects the degradation characteristics or the light emitting characteristics of the self light emitting elements in accordance with information indicative of the degradation characteristics or the light emitting characteristics supplied from the self light emitting elements to the detection circuit via the signal lines.

* * * * *